US009656381B2

(12) United States Patent
Niles et al.

(10) Patent No.: US 9,656,381 B2
(45) Date of Patent: May 23, 2017

(54) HOT STICK ADAPTER, COMBINATION, AND METHOD

(71) Applicant: Cantega Technologies Inc., Edmonton (CA)

(72) Inventors: Martin S. Niles, Stony Plain (CA); Keith I Yeats, Edmonton (CA); Edmond LeRouzic, Edmonton (CA)

(73) Assignee: Cantega Technologies Inc., Edmonton, Alberta (CA)

( * ) Notice: Subject to any disclaimer, the term of this patent is extended or adjusted under 35 U.S.C. 154(b) by 575 days.

(21) Appl. No.: 14/078,513

(22) Filed: Nov. 12, 2013

(65) Prior Publication Data

US 2015/0130200 A1 May 14, 2015

(51) Int. Cl.

| | |
|---|---|
| ***H01R 11/14*** | (2006.01) |
| ***B25G 3/12*** | (2006.01) |
| ***B25G 3/18*** | (2006.01) |

(52) U.S. Cl.

CPC ..... *B25G 3/12* (2013.01); *B25G 3/18* (2013.01); *H01R 11/14* (2013.01); *Y10T 29/49817* (2015.01); *Y10T 29/49826* (2015.01); *Y10T 403/32467* (2015.01)

(58) Field of Classification Search

CPC ..... B25J 1/04; B25J 5/06; B60M 1/04; H01R 11/14; H01R 43/20; H01R 43/26; H02G 1/00; Y10T 29/53222; Y10T 29/53283; Y10T 29/53896

USPC ..... 29/267; 81/53.1, 351; 294/106, 117, 294/118, 174

See application file for complete search history.

(56) References Cited

U.S. PATENT DOCUMENTS

| | | | | |
|---|---|---|---|---|
| 1,245,924 A * | 11/1917 | Johnson | ..... | A01B 1/18 294/104 |
| 2,288,776 A | 7/1942 | Bodendieck et al. | | |
| 2,316,428 A | 4/1943 | Heinrich | | |

(Continued)

FOREIGN PATENT DOCUMENTS

| | | |
|---|---|---|
| EP | 0183339 | 8/1985 |
| JP | 2012013594 | 1/2012 |

OTHER PUBLICATIONS

"Hot Sticks & Tools", Salisbury by Honeywell, 2003, Bolingbrook, IL.

(Continued)

*Primary Examiner* — Michael McCullough
*Assistant Examiner* — Brendan Tighe
(74) *Attorney, Agent, or Firm* — Anthony R. Lambert

(57) ABSTRACT

An adapter for a dielectric hot stick, the hot stick having a hook, the hook being movable along an axis of travel that includes a retracted position where the hook is within an axial passage in the hot stick, and an extended position where the hook is extended past a work end of the hot stick, the adapter comprising: a frame with a hot stick seat shaped to be mounted on the work end of the hot stick, the frame defining a lever passage positioned to at least partially align with the axial passage in use; and a lever assembly pivotally connected to the frame, the lever assembly having a first end with a connector for the hook and being at least partially within the lever passage, and the lever assembly having a second end defining or connected to a tool part to move the tool part relative to the frame to carry out a function when the hook moves along the axis of travel.

11 Claims, 6 Drawing Sheets

(56) References Cited

U.S. PATENT DOCUMENTS

| | | | | |
|---|---|---|---|---|
| 2,514,063 | A | 7/1950 | Hubbard | |
| 2,630,730 | A | 3/1953 | Thornton | |
| 2,658,784 | A | 3/1953 | Runde | |
| 3,666,311 | A | 5/1972 | McMullin | |
| 3,788,691 | A | 1/1974 | McMullin | |
| 3,840,969 | A | 10/1974 | Landis | |
| 4,242,930 | A | 1/1981 | Myers et al. | |
| 4,483,058 | A | 11/1984 | Clutter et al. | |
| 6,454,330 | B1 * | 9/2002 | Chen | B25J 1/04 294/104 |
| 7,111,526 | B1 * | 9/2006 | Flojo | B25B 5/06 294/118 |
| 7,834,269 | B2 | 11/2010 | Niles | |
| 2012/0151742 | A1 * | 6/2012 | Morin | B25B 31/00 29/432 |
| 2012/0284997 | A1 * | 11/2012 | Morin | H01R 11/14 29/525.01 |

OTHER PUBLICATIONS

"Shotgun Sticks", J.L. Matthews Co., Inc. [online], http://shopjlmatthews.com/store/Hot-Shotgun-ss6.html, accessed Jun. 17, 2013.

* cited by examiner

HOT STICK ADAPTER, COMBINATION, AND METHOD

TECHNICAL FIELD

This document relates to a hot stick adapter, combination, and method.

BACKGROUND

Various tools may be used to position or manipulate a part. In the electrical power transmission industry, a dielectric hot stick may be used to manipulate a part. For example, a shotgun hot stick, also known as a clamp stick, may be used to remotely tighten or loosen the bolt of a duckbill clamp or to deploy a clamp pin. Torque controlled clamp stick adapters are known from U.S. Pat. No. 4,242,930, and such extend the length of the clamp stick while restricting the maximum torque transfer from the clamp stick to the clamp to prevent over tightening.

Dielectric protectors, such as covers, may be used to insulate components of electrical power systems from animals and birds. Examples of such protectors are disclosed in U.S. Pat. No. 7,834,269. Some of these protectors may be positioned and secured in place using hot stick tools.

SUMMARY

An adapter for a dielectric hot stick, the hot stick having a hook, the hook being movable along an axis of travel that includes a retracted position where the hook is within an axial passage in the hot stick, and an extended position where the hook is extended past a work end of the hot stick, the adapter comprising: a frame with a hot stick seat shaped to be mounted on the work end of the hot stick, the frame defining a lever passage positioned to at least partially align with the axial passage in use; and a lever assembly pivotally connected to the frame, the lever assembly having a first end with a connector for the hook and being at least partially within the lever passage, and the lever assembly having a second end defining or connected to a tool part to move the tool part relative to the frame to carry out a function when the hook moves along the axis of travel.

A combination comprising: a dielectric hot stick having a hook, the hook being movable along an axis of travel that includes a retracted position where the hook is within an axial passage in the hot stick, and an extended position where the hook is extended past a work end of the hot stick; and a frame base with a first end mounted on the work end of the hot stick, and a second end shaped to define a tool mounting part; the frame base defining an actuator passage at least partially aligned with the axial passage and extended from the first end to the second end.

In various embodiments, there may be included any one or more of the following features: The frame comprises a base and a lever mounting part, the base defining the hot stick seat at a first end and a seat for the lever mounting part at a second end. The base comprises a collar. The collar comprises a gate. The collar comprises a first collar portion and a second collar portion axially spaced from the first collar portion, one of the first collar portion and the second collar portion containing the gate. An inner surface of the collar comprises a first set of one or more lateral protuberances and a second set of one or more lateral protuberances axially spaced from the first set, in which the gate shares the same axial position as at least the first set. A lock for securing the frame to the work end. The lock comprises a latch. The tool part comprises a fastener mount moveable relative to the frame between a first position and a second position to at least partially define a fastener drive path. The tool part comprises a first jaw and the frame comprises a second jaw, in which respective ends of the first and second jaw relatively converge when the hook moves. The lever assembly comprises a first arm defining the first end and a second arm defining the second end, the first arm is pivotally connected to the second arm, and the second arm pivotally connects the lever assembly to the frame. The adapter is connected to the hot stick. The base has a collar at the second end and the hook has an opened position, while extended, where the hook is pivoted about a pivot axis perpendicular to a hot stick axis, and in which the collar has a radial slot aligned to permit the hook to move into the opened position. The tool mounting part has a seat shaped to mate with a tool whose shape does not permit mounting on the work end of the dielectric hot stick. The tool is mounted on the tool mounting part, the tool having a lever assembly pivotally connected to the tool and having at least a first arm and a second arm, the first arm having a hook connector and being at least partially within the lever passage, and the second arm having a part that in use carries out a function by moving relative to the tool when the hook moves. Assembling the adapter or combination. Operating the combination within an electrical power transmission system. During operation the tool is positioned within a safe Limit of Approach and the tool is operated by a user who is positioned outside the safe Limit of Approach. The function comprises manipulating a protector for a component of the electrical power transmission system. Replacing the lever mounting part of the combination or the tool with a different lever mounting part or tool, respectively. The actuator passage is sized to permit user access to the hook from the second end when in the extended position. The actuator passage is sized such that the hook extends at least to the second end when in the extended position.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Elongated, insulated clamp sticks are used by linemen for work in and around energized and de-energized electrical lines or equipment. For example, certain types of clamp sticks are designed to mount and dismount electrical transmission and distribution equipment and, for this purpose, are provided with manually shiftable operating machanism for axially rotating the tool from a safe, remote position. In addition, such clamp sticks are normally provided with a mechanism for axially sliding a hook at a work end of the stick into and out of the insulative body of the clamp stick for reasons of safety and ease of operation. Common names for such clamp sticks include shot gun sticks, grip all sticks, AB Chance sticks and others.

Figures 1A, 1B, 1C, 1D:
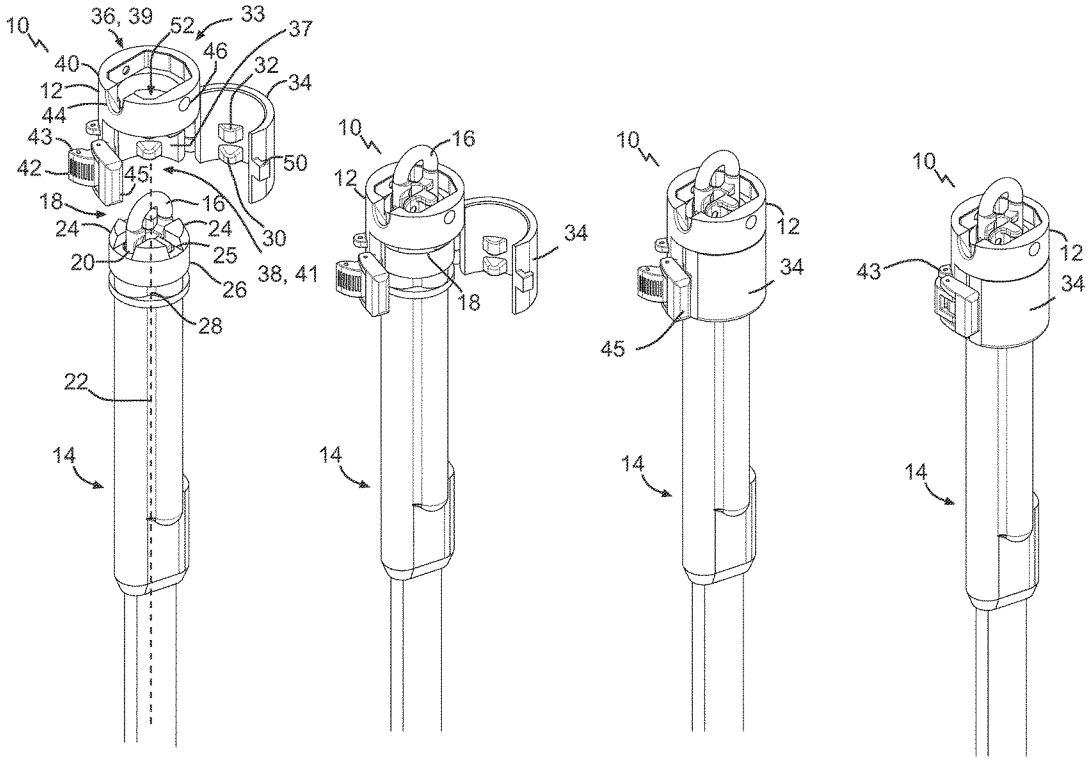
FIGS. 1A-G are a sequence of perspective views that illustrate a hot stick adapter and a method of installing the adapter to a hot stick.
Figure 1E:
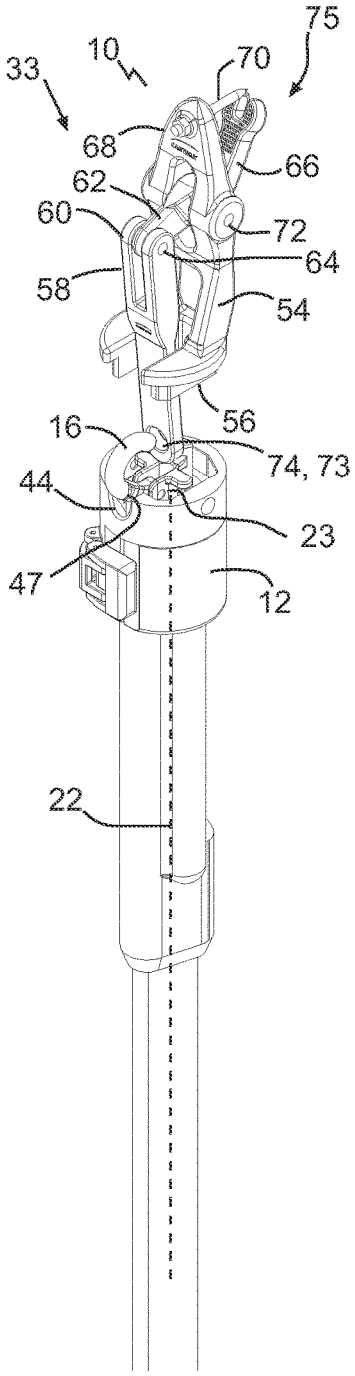
Figure 7B:
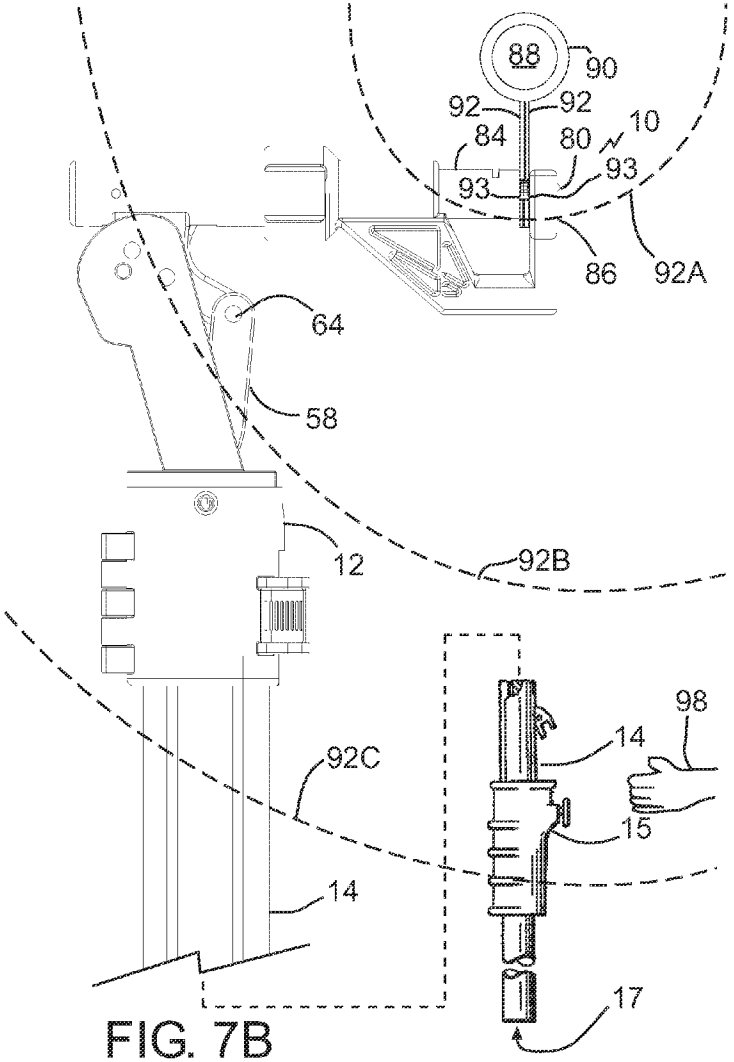
FIGS. 7A-B illustrate the operation of an embodiment of an adapter for applying a fastener through aligned holes in the flanges of a dielectric cover.

Referring to FIGS. 1A, 1B, and 7B, a dielectric hot stick 14 is illustrated. The hot stick 14 has a hook 16 at a work end 18 of the hot stick 14 (FIG. 1A). The hook 16 is movable along an axis of travel 22 that includes a retracted position (FIG. 7B) where the hook 16 is within an axial passage 20 (FIG. 1A) in the hot stick 14, and an extended position (FIG. 1B) where the hook 16 is extended past socket 18. Referring to FIG. 1E, the hook 16 may have an opened position, while extended, where the hook 16 is pivoted about a pivot axis 47 perpendicular to hot stick axis 22. Movement between an extended closed and extended open position is a conventional feature of a clamp stick and occurs using a spring or other biasing element (not shown) connected between a hook actuating rod 23 and hook 16. Thus, when the hook 16 extends sufficient past work end 18 where the confining walls of passage 20 are no longer present to resist the opening bias force. Referring to FIG. 7B, a shiftable slider 15 or other mechanism may be positioned at a user end 17 of hot stick 14 for a user 98 to remotely translate hook 16.

Clamp sticks are useful for applications that require the use of the hook at the work end of the stick. For example, a clamp stick is useful for tightening an eye bolt located high up above the ground. However, clamp sticks may be less useful and sometimes useless for other applications. For example, it may be difficult to use a clamp stick alone to remotely install or manipulate a dielectric cover used to protect a component of an electrical power transmission system. Electrical equipment is commonly retrofitted with such dielectric protectors in order to protect birds, animals, and lineman from electrical shock, and to prevent power outages at substations and other electrical equipment. Such protectors may be of the variety disclosed in the inventor's own U.S. Pat. No. 7,834,269.

Referring to FIG. 7B, a dielectric protector 90 for a component 88 of such a system may have holes 93 in corresponding flanges 92. Such holes 93 may be difficult or impossible to grip with a hot stick hook 16 depending on the hole size and spacing from flange edges, among other factors. Thus, specialized tools are used to manipulate such protectors 90.

Figure 1F:
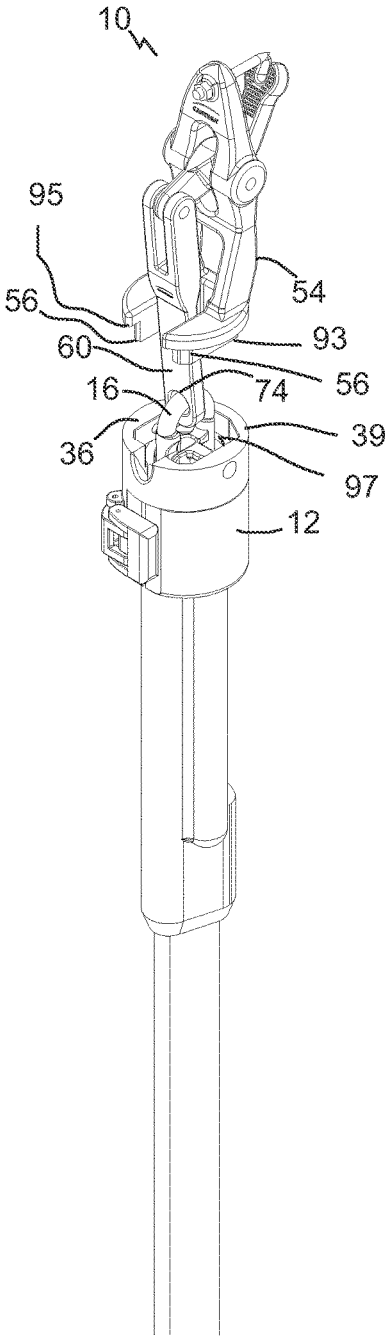
Figure 1G:
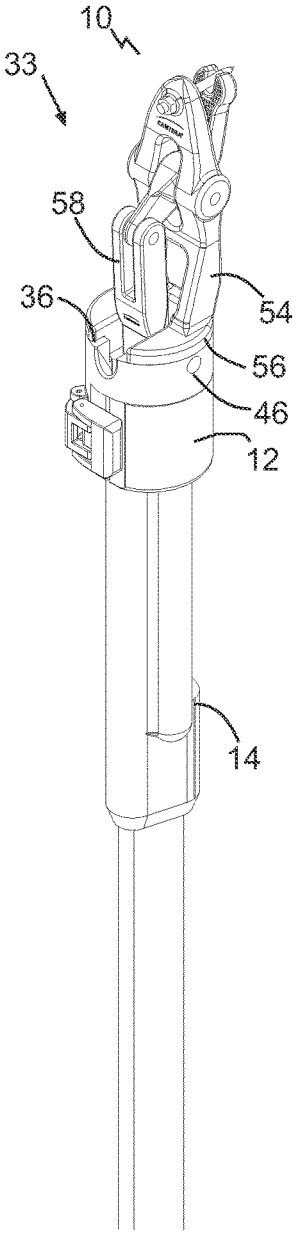

Referring to FIGS. 1A and 1G, an adapter 10 is illustrated for mounting on hot stick 14. Adapter 10 comprises a frame 33 and a lever assembly 54. Frame 33 may include a base 12 (FIGS. 1A and 1G) and a tool or lever mounting part, which may include the lever assembly 54 (FIG. 1G). Frame 33 includes a hot stick seat 38 shaped to be mounted on the work end 18 of the hot stick 14 (FIG. 1A). Thus, if frame 33 is a collar as shown, the collar dimensions, such as inner diameter, are sufficient to fit hot stick seat 38 over and around work end 18, accommodating any lateral or axial protrusions and recesses in work end 18.

Figure 5:
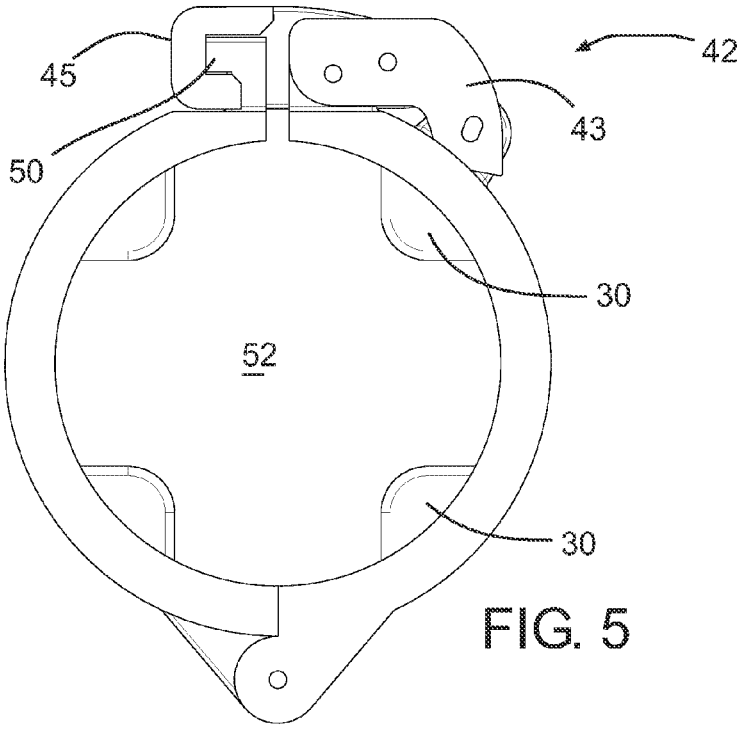
FIG. 5 is a section view taken along the 5-5 section lines from FIG. 4.
Figure 4:
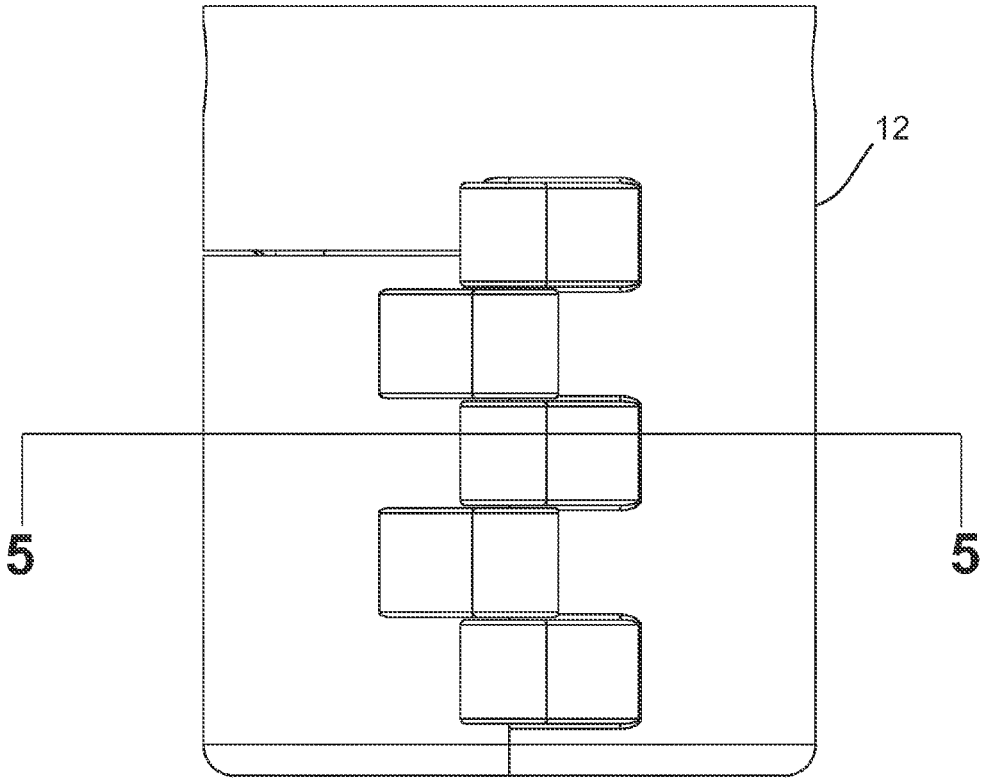
FIG. 4 is a side elevation view of the base of FIGS. 2 and 3.

Base 12 may define the hot stick seat 38 at a first end 41 of base 12, and a seat 36 for the lever mounting part 54 at a second end 39. Referring to FIGS. 1A and 5 the frame 33 may define an actuator or lever passage 52 positioned to at least partially align with the axial passage 20 in use. Lever passage 52 extends from the first end 41 to the second end 39 of base 12 (FIG. 1A).

Figure 6A:
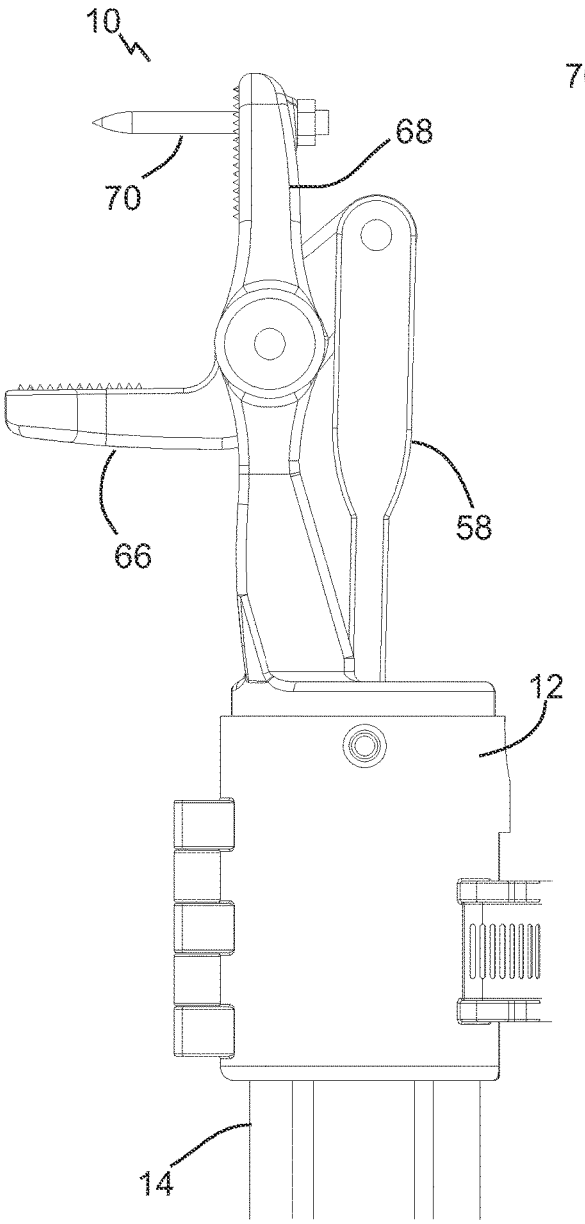
FIGS. 6A-B illustrate the operation of an embodiment of an adapter for gripping the flange hole of a dielectric cover.
Figure 6B:
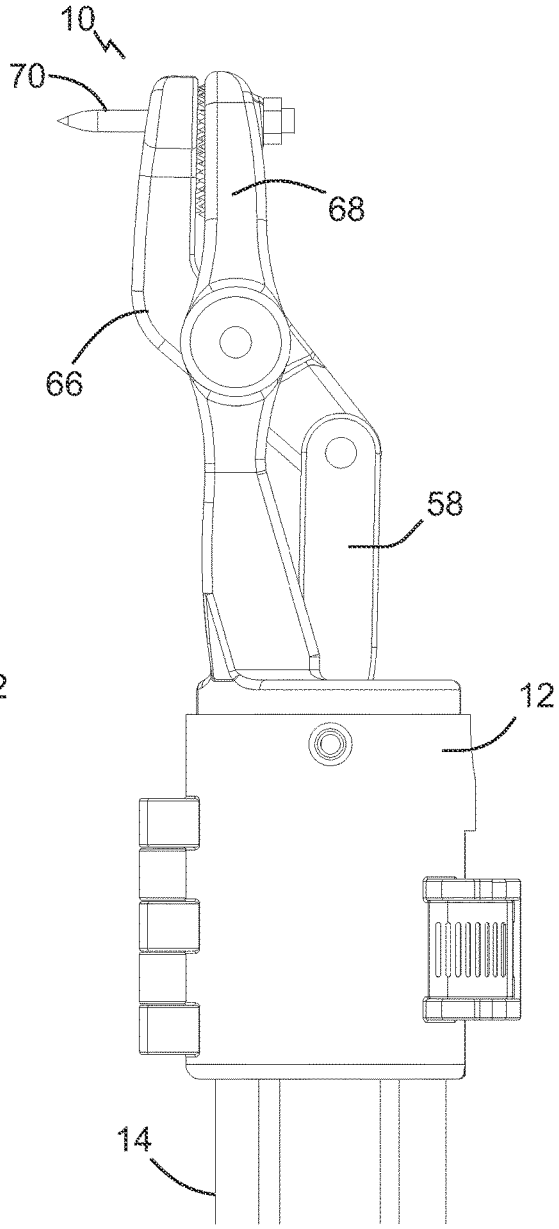
Figure 7A:
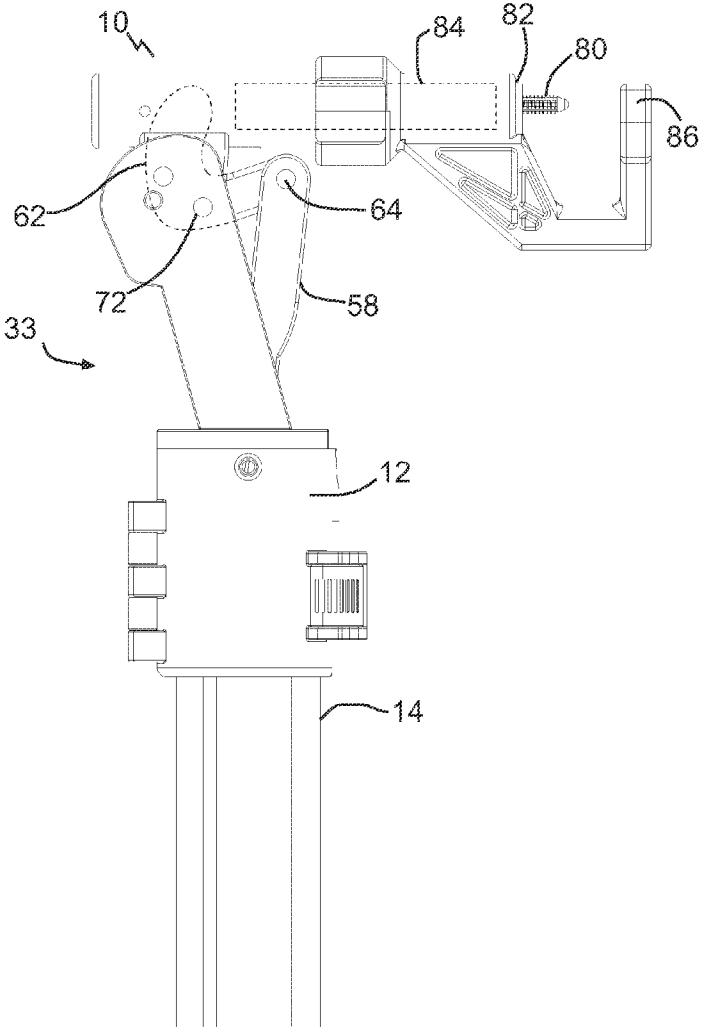

Lever assembly 54 is pivotally connected to the frame 33, for example at pivot point 72 (FIG. 1E). The lever assembly 54 has a first end 73 with a connector 74 such as a hook or eyelet as shown, for the hook 16. The first end 73, which may be defined by a first arm 58, is at least partially within the lever passage 52, as in the example shown where the first arm 58 is able to reciprocate within passage 52. The lever assembly 54 also has a second end 75, which may be defined by a second arm 62, defining or connected to a tool part, in this case defining a jaw 66, to move the jaw 66 relative to the frame 33, in this case a first jaw 68. Movement of jaw 68 relative to jaw 66 carries out a function, in this case to open and close jaws 66 and 68, when the hook 16 moves along the axis of travel 22 (FIGS. 1E, 6A, and 6B). Other functions may be carried out, for example as shown in FIGS. 7A-B discussed further below. The translation force provided by reciprocation of hook 16 may be converted by lever assembly 54 into various useful forms, for example sliding or translation force along an axis distinct from axis 22, swinging force, or rotational force.

The first arm 58 may be pivotally connected to the second arm 62 as shown at pivot point 64. The second arm 62 may pivotally connect the lever assembly 54 to the frame 33 as shown at pivot point 72. Such a mechanical linkage permits opening and closing of jaws 66, 68 on extension and retraction, respectively, of hook 16. Opening and closing of jaws 66, 68 results in convergence and divergence, respectively, of respective ends of jaws 66, 68 as shown. A tooth 70 may extend from one jaw, in this case jaw 68, for positioning within a hole 93 of a flange 92 of a protector 90 to position the flange 92 as is disclosed in US patent publication no. 20120284997, which is incorporated by reference.

Referring to FIGS. 7A-B, the tool part may comprise a fastener mount 82 moveable relative to the frame 33 between a first position (FIG. 7A) and a second position (FIG. 7B) to at least partially define a drive path for a fastener 80. A fastener 80 may include a Christmas tree fastener as shown, for example for the purpose of fastening together corresponding flanges 92 with aligned holes 93, of a protector 90 of a component 88 of an electrical power transmission system. A backing arm 86 may be provided on frame 33 for retaining the flanges 92 in the drive path to facilitate fastener installation. The embodiment of FIGS. 7A-B is an example of the translation force of hook 16 being converted into translation force in another axis, in this case the fastener drive path along which piston 84 travels to translate fastener mount 82. Piston 84 may be connected to second arm 62 for displacement by second arm 62. Examples of such tools are shown in US patent publication no. 20120151742, which is incorporated by reference.

Figure 2:
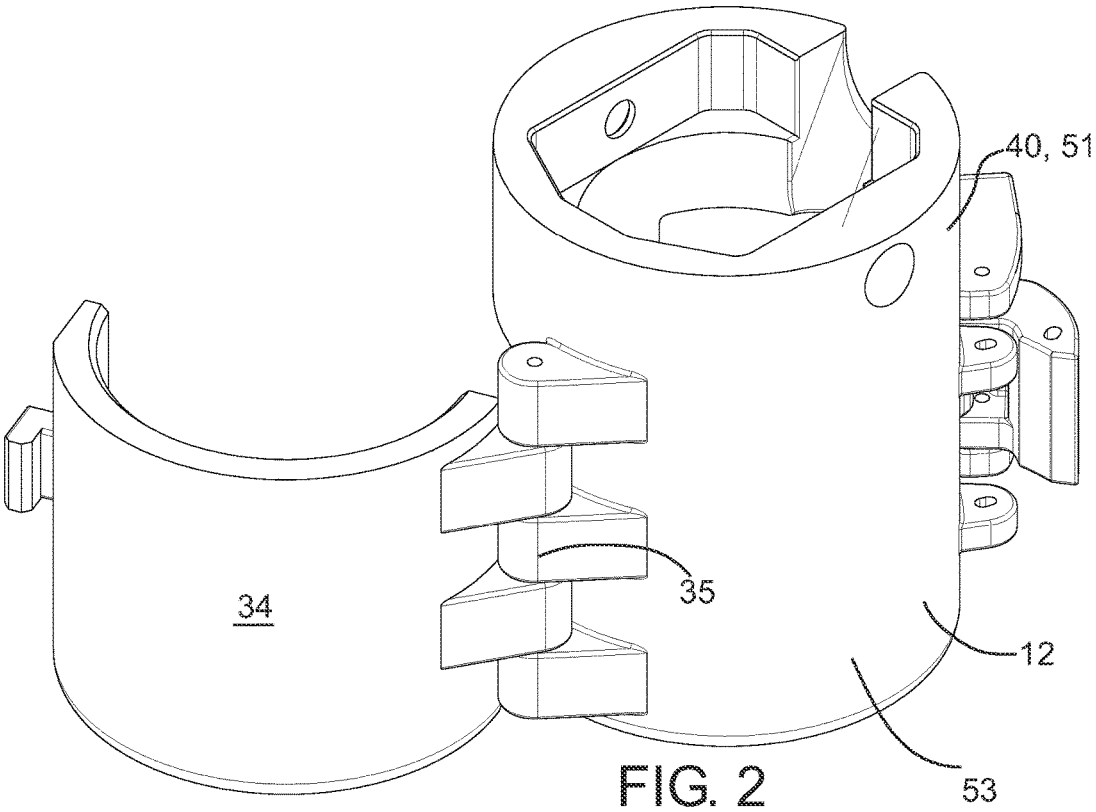
FIGS. 2 and 3 are top and bottom perspective views of the base of the adapter of FIGS. 1A-G.
Figure 3:
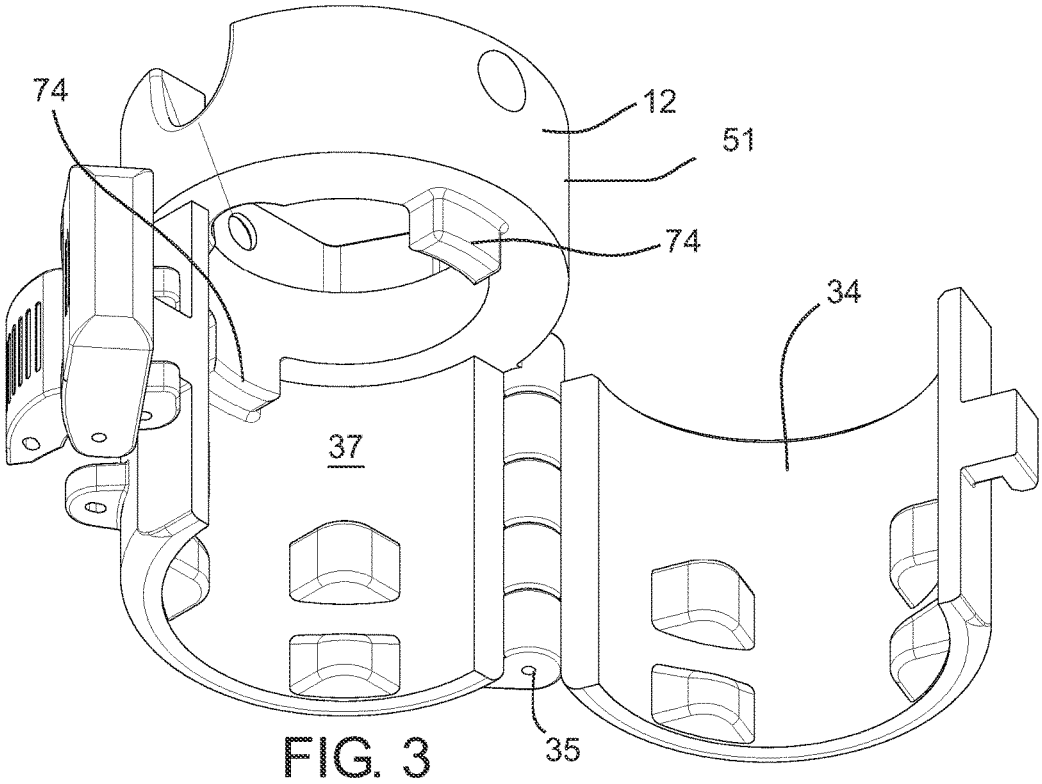

Referring to FIGS. 1A and 2-3, the base 12 may comprise a collar 40, for example with a diameter shaped to permit work end 18 of hot stick 14 to fit within collar 40. Collar 40 may have a first collar portion 51 and a second collar portion 53 axially spaced from the first collar portion 51 (FIGS. 2-3). A gate 34 may be provided on collar 40. Referring to FIG. 1A, one of the first collar portion 51 and the second collar portion 53 may contain gate 34, which may be a radially swing gate rotating about hinge 35 as shown. An inner surface 37 of the collar 40 comprises a first set 32 of one or more lateral protuberances and a second set 30 of one or more lateral protuberances axially spaced from the first set 32. The gate 34 may share the same axial position as at least one of the sets, in this case both sets 30 and 32. Thus, when the gate 34 is closed, sets 30 and 32 radially slide into position, in this case above and below a flange 28 of hot stick 14, to lock base 12 to work end 18 (FIG. 1A-B).

Referring to FIGS. 1A, 1C, 1D, and 5, a lock may be provided for securing the frame 33 to the work end 18 of hot stick 14. The lock may comprise a latch 42, which may be of a suitable variety such as an over the center latch as shown (FIGS. 1A and 5), having a handle 43 pivotally mounted to collar 40. Pivotally mounted to the handle 43 may be a tab 45 shaped to latch a hook 50 when handle 43 is pressed. The closing sequence of latch 42 is shown from FIGS. 1B-D. First, the gate 34 is closed (FIGS. 1B-C). Next, the tab 45 is hooked on hook 50 of gate 34 (FIG. 1C). Finally, the handle 43 is depressed to put the tab 45 under sufficient tension against hook 50 to retain gate 34 in the closed position shown (FIG. 1D).

Referring to FIG. 1E, as discussed above the hook 16 may have an opened position where the hook 16 is pivoted outwards. In the example shown collar 40 would be positioned to interfere with hook 16 opening, but for a radial slot 44 cut out of collar 40 and aligned to permit the hook 16 to open as shown. Radial slot 44 allows collar 40 to axially extend from work end 18 while still permitting opening. The lever passage 52 may also be generally sized to permit user access to the hook 16 from the second end of base 12 when in the extended position. The hook 16 may extend at least to the second end of base 12 when in the extended position.

Referring to FIG. 1F, second end 39 of base 12 may be shaped or otherwise configured to mate with a tool, such as lever assembly 54, whose shape does not permit mounting directly on the work end 18 of the dielectric hot stick 14. Thus, in the example shown a base mounting end 93 of part 54 has a pair of ledges 56 depending from an underside 95, the ledges 56 being positioned to fit within a correspondingly shaped recess 97 in second end 39. Such a configuration would not mate with the protrusion 24 and recess 25 pattern of work end 18 found on most hot sticks 14 (FIG. 1A). Thus, the provision of base 12 allows greater flexibility in the type of tool that may be attached to a hot stick 14, as well as facilitating a mechanism for transferring the translation force of hook 16 into useful applications with such tools.

In some cases a variety of tools may be provided with base mounting ends 93 shaped to fit seat recess 97 in base 12. Examples are shown in FIGS. 6A-B and 7A-B, although other types of tools may be used. In some cases a method may include replacing one such tool for another tool, while the base 12 is installed or separate from hot stick 14. Thus, instead of carrying a set of full length hot stick tools, a user may bring a single hot stick 14 to site with a variety of adapters 10.

Referring to FIGS. 1A-G a method of assembling the adapter 10 with hot stick 14 is illustrated. First, the base 12 is mounted on work end 18 (FIGS. 1A-B), so that the first and second sets 30 and 32 are axially below and above the flange 28 of hot stick 14. Next, gate 34 is closed and latched as discussed above (FIGS. 1B-D). Next, lever mounting part 54 is connected to hook 16, for example by securing connector 74 with hook 16 in the opened position as shown (FIG. 1E). In some cases the connector 74 may be connected with or without the parent part 54 attached before base 12 is installed. Next, once hook 16 is closed around connector 74, hook 16 is retracted and part 54 sits within recess 97 of base 12 (FIG. 1G). The part 54 may be secured in place using one or more fasteners, for example bolts (not shown) passed through holes 46 in base 12 (FIG. 1G). Adapter 10 is now ready for remote use.

Referring to FIGS. 7A-B, adapter 10 may be operated in an electrical power transmission system, for example containing component 12. In the example shown adapter 10 is shown installing a fastener 80 through aligned holes 93 in corresponding flanges 92 of a protector or cover 90 for a component 12 of the system. In other cases the adapter 10 may be used to manipulate such as position the protector 90.

The adapter 10 may be positioned within a safe Limit of Approach 92C and the tool operated by a user 98 who is positioned outside the safe Limit of Approach 92C (FIG. 7B). As discussed above, the electrical power transmission system may be energized. This allows protector 90 to be remotely installed or manipulated. Standard limits of approach 92 are generally set by the IEEE for live electrical systems. It should be understood that the limits of approach may vary according to region. The limits of approach 92 around energized equipment generally widens as the voltage increases. In FIG. 7B, the limits of approach 92 correspond to increasing voltages, and thus increasing radii, from limits of approach 92A-C. For this purpose, hot stick 14 may be provided in a length that is suitable for the various limits of approach standards in all jurisdictions.

Frame 33 is rigidly connected to work end 18 of hot stick 14 to remain stationary relative to hot stick 14 during use. A direct mechanical linkage between hook 16 and lever assembly 54 may be provided, such that positive control of assembly 54 is provided in response to hook 16 movement. Retracted and extended may not mean fully retracted or extended depending on the context. Suitable mechanisms for affixing the base 12 to work end 18 may be used, including clamps, wires, and fasteners.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. An adapter for a dielectric hot stick, the hot stick having a hook, the hook being movable along an axis of travel that includes a retracted position where the hook is within an axial passage in the hot stick, and an extended position where the hook is extended past a work end of the hot stick, the adapter comprising:

a frame with a base that forms a collar, which defines a work end receiving interior that forms a hot stick seat and is sized to permit the work end of the hot stick to fit within the collar, with a latch being mounted to the frame to secure and release the collar from the work end of the hot stick in use, the frame comprising a lever mounting part, the frame defining a lever passage positioned to at least partially align with the axial passage in use; and a lever assembly pivotally connected to the lever mounting part, the lever assembly having a first end with a connector for the hook and being at least partially within the lever passage, and the lever assembly having a second end defining or connected to a tool part to move the tool part relative to the frame to carry out a function when the hook moves along the axis of travel.

2. The adapter of claim 1 in which the base defines the hot stick seat at a first end and a seat for the lever mounting part at a second end opposite the first end.

3. The adapter of claim 1 in which the collar comprises a gate.

4. The adapter of claim 3 in which the collar comprises a first collar portion and a second collar portion axially spaced from the first collar portion, one of the first collar portion and the second collar portion containing the gate.

5. The adapter of any claim 3 in which an inner surface of the collar comprises a first set of one or more lateral protuberances and a second set of one or more lateral protuberances axially spaced from the first set, in which the gate shares the same axial position as at least the first set.

6. The adapter of claim 1 in which the tool part comprises a fastener mount moveable relative to the frame between a first position and a second position to at least partially define a fastener drive path.

7. The adapter of claim 1 in which the tool part comprises a first jaw and the frame comprises a second jaw, in which respective ends of the first and second jaw relatively converge when the hook moves.

8. The adapter of claim 1 in which the lever assembly comprises a first arm defining the first end and a second arm defining the second end, the first arm is pivotally connected to the second arm, and the second arm pivotally connects the lever assembly to the frame.

9. The adapter of claim 1 connected to the hot stick.

10. An adapter for a dielectric hot stick, the hot stick having a hook, the hook being movable along an axis of travel that includes a retracted position where the hook is within an axial passage in the hot stick, and an extended position where the hook is extended past a work end of the hot stick, the adapter comprising:

a frame with a first end defining a hot stick seat shaped to be mounted on the work end of the hot stick, the frame defining a lever passage positioned to at least partially align with the axial passage in use, the frame having a second end that defines a tool mounting seat;

a plurality of tool parts, each tool part having a stationary part and a movable part supported by the stationary part, in which the stationary part of each of the plurality of tool parts is shaped to interchangeably mount to the tool mounting seat of the frame to remain stationary relative to the frame in use, with the stationary part of a respective one of the plurality of tool parts being mounted to the tool mounting seat of the frame;

a lever assembly pivotally connected to the respective one of the plurality of tool parts, the lever assembly having a first end with a connector for the hook and being at least partially within the lever passage, the lever assembly having a second end that is structured to move the movable part of the respective one of the plurality of tool parts relative to the frame to carry out a function when the hook moves along the axis of travel, with the stationary part of the respective one of the plurality of tool parts being mounted to the tool mounting seat of the frame;

in which each tool part of the plurality of tool parts is structured such that, when the tool part is mounted to the frame, the second end of the lever assembly moves the movable part of the tool part relative to the frame to carry out a function unique to the tool part when the hook moves along the axis of travel; and in which the stationary part of each of the plurality of tool parts is shaped to be incompatible with the work end of the hot stick.

11. The adapter of claim 10 in which the lever assembly is a plurality of lever assemblies, and each tool part of the plurality of tool parts comprises a respective lever assembly of the plurality of lever assemblies, with the respective lever assembly structured move to the movable part of the tool part.

* * * * *